US008757595B2

(12) United States Patent
Garzanelli

(10) Patent No.: US 8,757,595 B2
(45) Date of Patent: Jun. 24, 2014

(54) CARPET STRETCHER AND METHOD OF USE

(76) Inventor: Marion T. Garzanelli, Virginia City, NV (US)

( * ) Notice: Subject to any disclaimer, the term of this patent is extended or adjusted under 35 U.S.C. 154(b) by 0 days.

(21) Appl. No.: 13/424,872

(22) Filed: Mar. 20, 2012

(65) Prior Publication Data

US 2013/0248788 A1 Sep. 26, 2013

(51) Int. Cl.
*B65H 77/00* (2006.01)

(52) U.S. Cl.
USPC ..... 254/210; 254/211; 254/212; 294/8.6

(58) Field of Classification Search
USPC ..... 254/199, 200, 209–212; 294/8.6
See application file for complete search history.

(56) References Cited

U.S. PATENT DOCUMENTS

| | | | | |
|---|---|---|---|---|
| 61,663 | A | 1/1867 | hungerford | |
| 58,831 | A | 10/1868 | Hungerford | |
| 3,706,440 | A | 12/1972 | Ross | |
| 3,747,157 | A | 7/1973 | Szymanski | |
| 3,752,440 | A | 8/1973 | Ream | |
| 5,150,884 | A | 9/1992 | Hyer et al. | |
| 5,782,458 | A | 7/1998 | Prinzi et al. | |
| 5,855,361 | A | 1/1999 | Krowchak | |
| 7,237,764 | B2 * | 7/2007 | Despins | 254/200 |
| 7,451,961 | B2 | 11/2008 | Kirker et al. | |
| 7,722,012 | B2 | 5/2010 | Kirker et al. | |
| 2011/0068310 | A1 * | 3/2011 | Despins et al. | 254/211 |

* cited by examiner

*Primary Examiner* — Emmanuel M Marcelo
*Assistant Examiner* — Angela Caligiuri
(74) *Attorney, Agent, or Firm* — Long & Chybik; John D. Long, Esq.

(57) ABSTRACT

One possible embodiment for the invention could be a carpet-anchoring carpet stretcher comprising a front telescopic portion, the front telescopic portion reversibly anchors only to a carpet and connects to a rear anchor portion, the front telescopic portion further comprises a stretching mechanism that lengthens the front telescopic portion; the rear anchor portion, the rear anchor portion having a base with two opposing ends, each opposing end pivotally connecting to one end of a respective anchor leg while the other end of the respective anchor leg reversibly anchors only to the carpet; wherein the stretching mechanism generates a rearward force to the rear anchoring portion that laterally redistributes a portion of the rearward force to otherwise prevent the creation of one or more wrinkles in a portion of the carpet located proximately between the anchoring legs.

19 Claims, 3 Drawing Sheets

CARPET STRETCHER AND METHOD OF USE

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO A "MICROFICHE APPENDIX"

Not Applicable.

1. Field of the Invention

The present invention relates to carpet stretchers and their method of use. More particularity, to those carpet stretchers that reversibly attach themselves only to the carpet itself and not the floor or other portion of the building structure to which the carpet may be attached.

2. Background

Wall-to-wall carpeting (e.g., carpeting that is generally affixed to a flooring) has existed in the United States for over a hundred-and-fifty years, but it was not until the commercial availability of inexpensive synthetic fibers combined with the post-World War Two housing boom did wall-to-wall carpeting come into general use in the United States. Along with this development, concurrently arose a need to further develop carpet-stretching technologies to alleviate the occurrence of undesired wrinkles (e.g., bulges, bubbles, folds, ridges, creases, etc.) in the final laid carpet.

This carpet-stretching technology has included the use of structure-anchored carpet stretchers. One such carpet stretcher could have a front telescopic portion and a rear anchor portion. The front telescopic portion could be reversibly anchored to a section of the carpet that is to be driven ahead of carpet stretcher to move that carpet section to a point on the flooring where that carpet section is to be affixed. The rear anchoring portion could face another section of the carpet already attached to floor. The rear anchoring portion could then be reversibly anchored to the floor (e. g., by penetrating through the carpet/padding to attach directly to the floor or by connecting to a tacking strip that is attached to the floor) or reversibly braced against a vertical portion of a building structure that is proximate to the floor/carpet. The front telescopic portion could further feature a stretching mechanism that could elongate (e.g., telescopically) the front telescopic portion and the overall operating length of the carpet stretcher as well. In doing so, the elongation action could impart a rearward force towards the rear anchor portion allowing the carpet stretcher to push forward the carpet section that was ahead of the carpet stretcher.

These structure-anchored carpet stretchers may have some operational limitations related to their means of anchoring. Floor-anchored versions, when they penetrate the carpet/padding to attach themselves directly to the floor, may also create noticeable holes or tears in the carpet by their attachment activities. The vertical structural-anchored versions could further require the use of multiple extensions to connect the carpet stretcher to their respective vertical surface(s). Generally, these extensions are lengths of heavy metal tubes that need to be carried to and from the work site; require additional operational time to setup, assemble, and connect to the carpet stretcher; may need additional tubes to meet a required operating length for the carpet stretcher operating on a large area carpet; and may add additional costs and man-hours to the carpet-stretching operations.

One possible solution to these carpet-stretching issues could be the use of a carpet-anchored carpet stretcher that only reversibly anchors to or engages the carpet itself and not the horizontal (e.g., flooring/tack strip) or the vertical (e.g., walls, corners, door jams, etc.) portions of a building structure supporting or otherwise proximate to the carpet being laid. These carpet-anchored carpet stretchers could utilize one or more pin pads/needle blocks (e.g., a rack or flat of multiple pins) that reversibly anchors to or engages only the carpet (without creating noticeable or significant hole damage in the carpet) and could avoid attaching to the building structure that is supporting or otherwise proximate to the carpet. Once deployed upon the carpet, the carpet stretcher's stretching mechanism could be activated to generally increase the length of the carpet stretcher to stretch out the carpet as needed.

However, even carpet-anchored carpet stretchers may have their limitations. When their stretching mechanism are activated, the stretching motion/rearward force so imparted may also move the carpet proximate to the rear of carpet stretcher in a manner that creates an one or more undesired wrinkles in that portion of the carpet.

What could be needed is a carpet-anchored carpet stretcher that stretches the carpet without otherwise creating one or more undesired wrinkles in the carpet proximate to the rear of the carpet stretcher. One such solution could be a carpet-anchored carpet stretcher having a rear anchor portion with a base that pivotally attaches to a pair of anchor legs that reversibly anchor only to the carpet. Each of the respective anchor legs can then pivot sufficiently to laterally redistribute a portion of the rearward force that is generated when the length of the carpet stretcher is increased. This lateral redistribution of the portion of the rearward force could further result in of lateral movement of the carpet section between the anchor legs to otherwise prevent the remaining rearward force from creating of one or more wrinkles in that carpet section.

SUMMARY OF ONE EMBODIMENT OF THE INVENTION

Advantages of One or More Embodiments of the Present Invention

The various embodiments of the present invention may, but do not necessarily, achieve one or more of the following advantages:

- to provide a carpet-anchored carpet stretcher otherwise prevents the creation of a one or more undesired wrinkles in section of carpet behind the carpet-anchored carpet stretcher;
- the ability to use the rearward force created by the telescopic extension of the carpet-anchored carpet stretcher to laterally move a section of carpet that is proximate to the rear of the carpet-anchored carpet stretcher to generally prevent the creation of unwanted wrinkles in that section of carpet;
- to provide a carpet-anchored carpet stretcher whose rear anchor portion has pivoting legs that laterally redistributes or redirects a portion of the rearward force created by the carpet-anchored carpet stretcher;
- the ability to stretch a carpet using carpet-anchored carpet stretcher having a set of pivotally moving anchor legs that prevent wrinkles from occurring in a section of carpet behind the carpet-anchored carpet stretcher;

to provide a carpet-anchored carpet stretcher having a set of anchor legs that laterally move a section of carpet located between the anchor legs to otherwise prevent wrinkles from occurring in that section of the carpet; and to provide a carpet-anchored carpet stretcher having pivotally attached legs that move away from an initial 45° degree relationship from their base to laterally redirect or transfer at least a portion of a longitudinally-oriented rearward force to otherwise prevent the creation of wrinkles in the section of carpet located between the anchor legs.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a carpet stretcher comprising a front telescopic portion, the front telescopic portion reversibly anchors only to a carpet and connects to a rear anchor portion, the front telescopic portion further comprises a stretching mechanism that lengthens the front telescopic portion; the rear anchor portion, the rear anchor portion having a base with two opposing ends, each opposing end pivotally connecting to one end of a respective anchor leg while the other end of the respective anchor leg reversibly anchors only to the carpet; wherein the stretching mechanism generates a rearward force to the rear anchoring portion that laterally redistributes a portion of the rearward force to otherwise prevent the creation of one or more wrinkles in a portion of the carpet located proximately between the anchoring legs.

Another embodiment of the invention could be a carpet stretcher comprising a front telescopic portion that reversibly anchors only to a carpet, the front telescopic portion further having a capacity for increasing the length of the carpet stretcher, the capacity further creates a rearward force directed to a rear anchor portion that is attached to the front telescopic portion; the rear anchor portion having a base, the base pivotally connects to a pair of anchoring legs, each anchoring leg further reversibly engages only the carpet; wherein the rearward force causes the anchor legs to distribute a portion of rearward force laterally to otherwise prevent the remaining rearward force from creating one or more wrinkles in a portion of the carpet proximately located between the anchoring legs.

Another possible embodiment could be a method or process for operating a carpet-anchored carpet stretcher comprising of the following steps, providing a carpet stretcher that only engages to a carpet, the carpet stretcher having front telescopic portion with a capacity for increasing the length of the front telescopic portion, the front portion connecting to a rear anchor portion having a base with a pair of spaced-apart, angled opposing ends, each angled opposing end further pivotally connects to a respective anchoring leg, each anchor leg that only engages the carpet; engaging the carpet with the carpet stretcher while the front telescopic portion is in a compacted state; using the capacity for increasing the length of the front telescopic portion to further expand the length of the carpet stretcher and impart a rearward force towards the rear anchoring portion; and distributing some of the rearward force laterally through the rear anchoring portion to otherwise prevent the creation of one or more wrinkles in a portion of the carpet to which the rear anchoring portion is engaged.

The above-description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
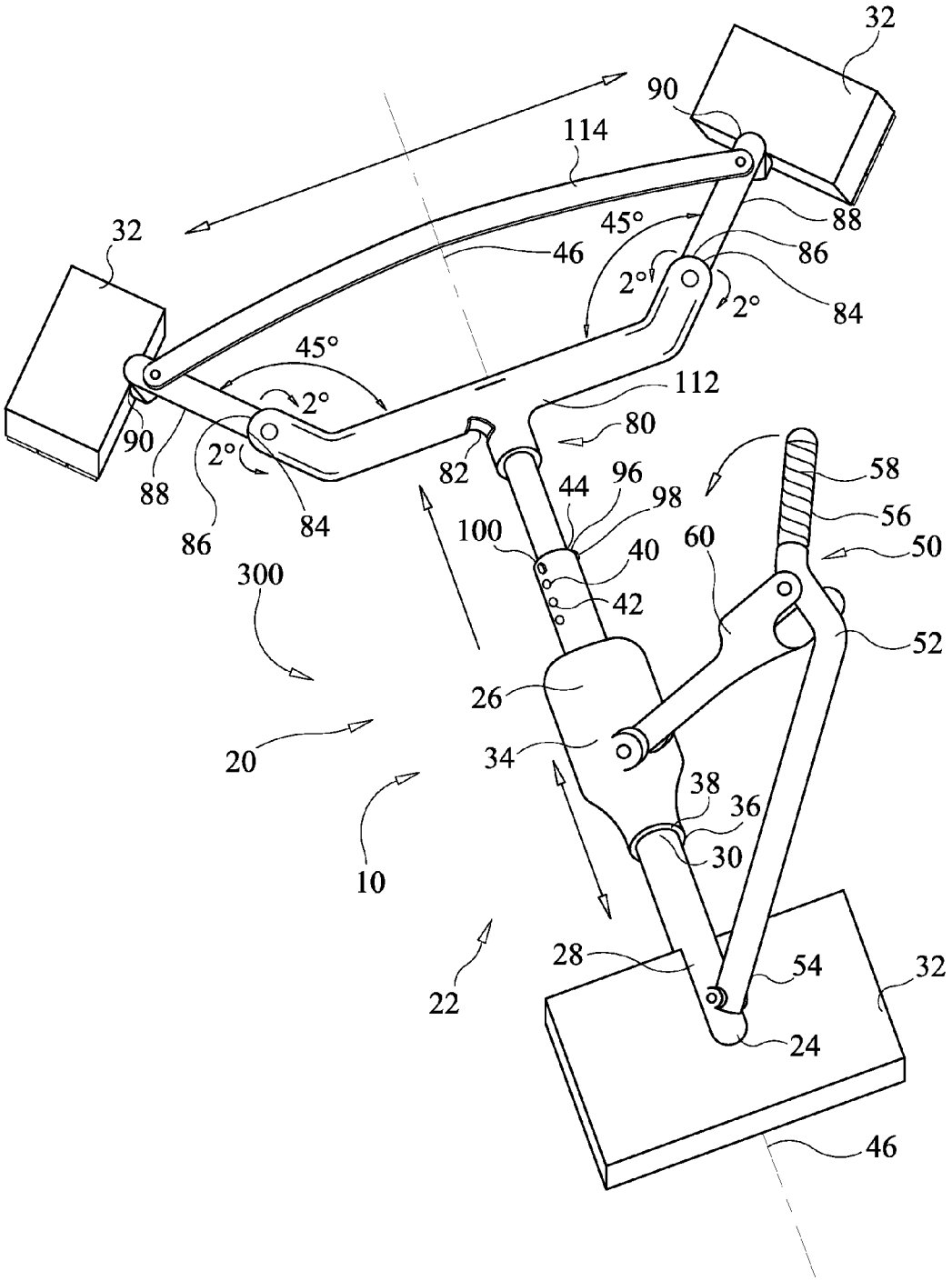
FIG. 1 is substantially a perspective view of one possible embodiment of the present invention.
Figure 2:
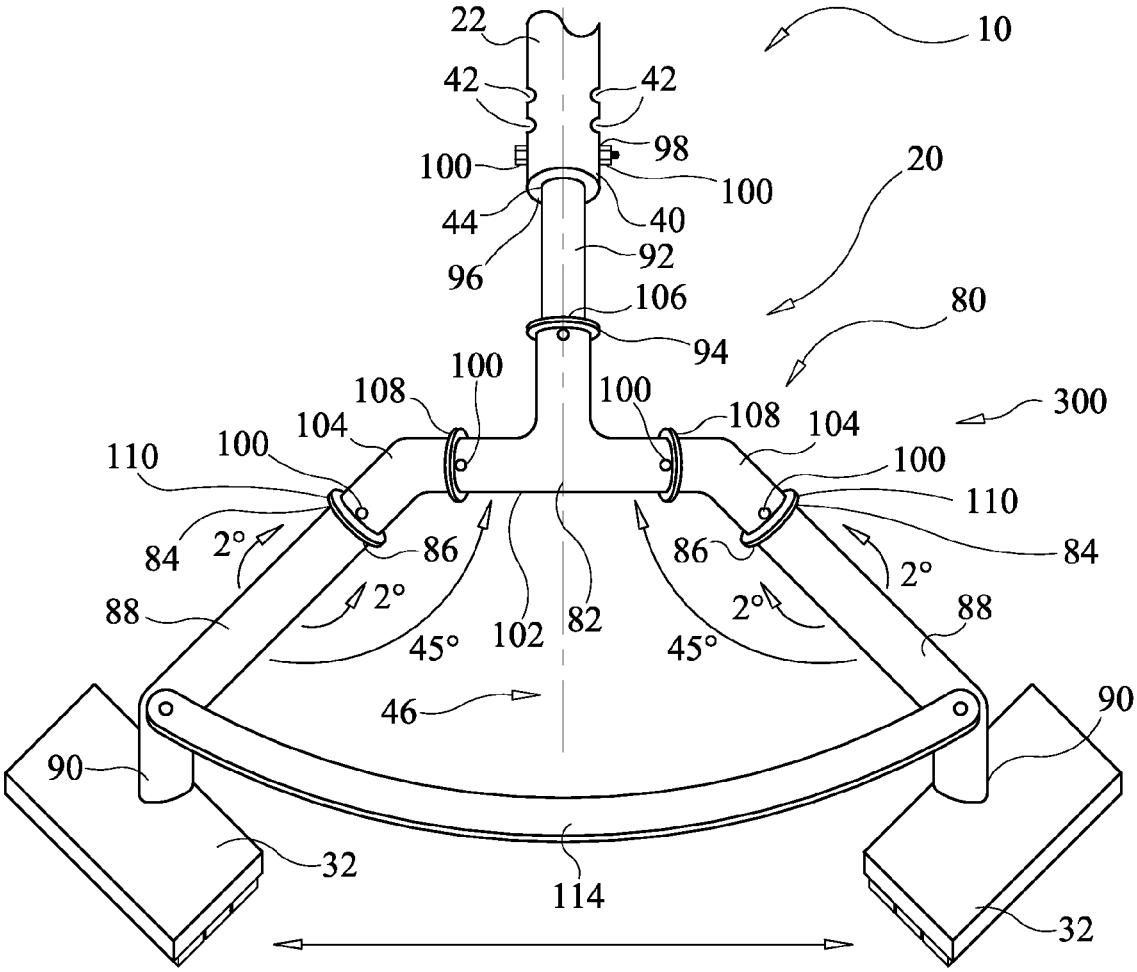
FIG. 2 is substantially a perspective view of another possible embodiment of the present invention.

As substantially shown in FIGS. 1 and 2, the present invention 10 could comprise of carpet-anchored carpet stretcher 20 and method of use 200. The carpet stretcher 20 could comprise of a front telescopic portion 22 and a rear anchor portion 80. The front telescopic section 22, which generally pushes the carpet 300 ahead of the carpet stretcher 20, could be adjustably connected to the rear anchor portion 80, which generally anchors the carpet stretcher 20.

The front telescopic portion 22 could comprise of a stretching mechanism 50, a front section 24, and a back section 26, wherein a portion of the front section 24 may be generally telescopically received by the back section 26. The stretching mechanism 50 may be generally movably connected to both sections 24, 26 to allow it to move the two sections 24, 26 apart from one another to generally increase the length of the carpet stretcher 20. This movement also generates a rearward force towards the rear anchor portion 80.

Both the front and rear sections 24, 26 are generally tubular in construction. The front section 24 could be a length of metal bar with a first end 28 being attached to the needle pad 32 (e.g., pin block) while the other second end 30 is reversibly-received within a body 34 of the back section 26. A segment (containing the second end 30) or the front section 24 could pass through a front aperture 36 be received within a receiving channel 38 of the body 34 that may be oriented along the center longitudinal axis 46 of the invention 10. The body 34 could be bottle-shaped with the front aperture 36 being located at the narrow end of the body 34. A first hollow tube 40 with an open end 44 could project from the wide end of the body 36 oriented along the center longitudinal axis 46.

The first hollow tube 40 could further have two sets or series of perforations 42, with each series longitudinally located along a respective side of the first hollow tube 40. The perforations 42 for one series could match up laterally respective to the perforations 42 for the other series. This perforated section of the first hollow tubing 40 could reversibly receive through its unattached open end 44 a portion of a second hollow tube 92 projecting from the rear anchor portion 80 to reversibly and adjustably connect the front telescopic portion 22 to the rear anchor portion 80.

The stretching mechanism 50 could be used to variably adjust the length of the first telescopic portion 22 and hence the overall length of the carpet stretcher 20. In at least one embodiment, as generally known in the art, the stretching mechanism 50 generally translates and magnifies the arm motion of the operator (not shown) into a force needed to create the carpet-stretching movement of the invention 10. Such an embodiment could embody a handle 52, whose first handle end 54 could be pivotally attached to the first section 24 of the front telescopic portion 22. The handle's second handle end 56 could have at one end a grip 58 for grasping by the operator. Proximate to the grip 58 could be pivotally attached one end of a lever 60. The lever's other end may pivotally attach proximate to the top of the back section 26.

In operation, as the operator (not shown) grasps and presses down on the grip 58 of the handle 52 towards the back section 26, the combined motion of the handle 52 and lever 60 as they travel downward together substantially forces apart the two sections 24, 26 to generally telescopically increase the length of the front telescopic portion 22. This lengthening action may create a rearward force traveling along the central longitudinal axis 46 of the carpentry stretcher 20 towards the rear anchor portion 80. This action also substantially causes the front telescopic portion 22 (as anchored by the second anchor portion 80) to move and push forward the carpet 300 ahead of it to substantially create the carpet-stretching motion for the invention 10.

The rear anchor portion 80 could comprise of a base 82 connected to a pair of anchor legs 88. The base is generally C-shaped with two opposing base ends 84. Each base end 84 can be projected outward from the base 82 at a forty-five) (45°) degree angle relative to the remainder of the base 82. Each base end 84 could also be pivotally attached to a respective anchor leg 88 at the anchor leg's first end 86 while the other second end 90 of the respective anchor leg 88 could be attached to a respective needle pad/pin block 32. The pivoting attachment of each anchor leg 88 could allow each anchor leg to pivotally move up to two) (2°) degrees, (+/−) plus or minus, relative to its opposing base end 84. The resulting pivoting action could allow each anchor leg 88 to move from forty-three) (43°) degrees to forty seven) (47°) degrees relative to the base 82.

At the middle of the base 82 (e.g., between the two base ends 84) could project outward a second hollow tube 92. The second hollow tube 92 could feature a first tube end 94, through which the second hollow tube 92 attaches to the base 82, and an unattached second tube end 96, through which the second hollow tube 92 is adjustably received within the first hollow tube 40 to generally connect the second anchor portion 80 with the first telescopic portion 22. The second tube end 96 may feature a pair of apertures 98 with each aperture 98 being located on a respective side of the second hollow tube 92 so as to oppose the remaining aperture 98. In this manner, when the unattached second tube end 96 of the second hollow tube 92 is inserted through the open end 44 of the first hollow tube 40 of the front telescopic portion 22, the second tube's pair of apertures 98 may align up with one of the pairs of matched perforations 42 of first hollow tube 40. A fastener 100 (e.g., bolt and nut combination) could be passed through the aligned sets of matched perforations/apertures 42, 98 of both tubes 40, 92 to reversibly lock the two tubes 40,92 into place relative to one another to reversibly fix the distance between the first telescopic portion 22 and the rear anchoring portion 80.

In one embodiment of the invention, the base 82 could further have a cushion 112. This cushion 112 could be suitably constructed to comfortably support a portion of the operator body's placed upon the cushion 112/base 82. This could allow the operator (not shown) to comfortably lean in some of its weight upon the rear anchoring portion 80 to assist invention 10 successfully engage the desired portion of carpet 300. In one possible version, the cushion 112 could be a thick sturdy material such as outdoor carpeting that envelopes most of the base 82. A rectangular section of this material could be folded over the base 82 with some of material's opposing edges sewn together in a manner that generally leaves base's attachment points for the anchor legs 88 and second hollow tube 92 uncovered by the cushion 112.

In another embodiment, the rear anchoring portion 80 could further comprise of a strap 114 of webbing material (or other suitable flexible, sturdy material) that terminates in two strap ends, each strap end being respectively attached to an anchor leg 88 proximate to the leg's second end 90/needle pad 32. The strap 114 could help prevent the hyperextension movement of the anchoring legs 88 that could occur when the rearward force reaches the rear anchor portion 80 to move the anchoring legs 88 respective to the base 82. The strap 114 could prevent each anchor leg 88 from exceeding more that two degrees relative to its respective base end 84/forty-seven degrees relative to the base. In limiting anchor leg movement in that fashion, the strap 114 could also be seen as generally preventing unwanted stress upon/premature wearing of the anchoring legs' pivotal connections to the base 82.

In one possible embodiment of the invention 10, the base 82 could be comprises of a T-shaped, open-ended base pipe 102, a pair of forty-five) (45°) degree angled pipe ends 104, and a pair of anchor legs 88 with respective needle pads 32. The middle opening 106 of the base pipe 102 could attach to an expandable extension (e.g., second hollow tube 92) that serves to adjustably connect the front telescopic portion 22 to the rear anchor portion 80. Each of opposing open base ends 108 of the base pipe 102 could receive a forty-five degree) (45°) angled pipe end 104. This attachment of each pipe end 104 upon the base pipe 102 could generally place the unattached open ends of the pipe ends at a forty-five degree) (45°) angle relative to the base 82. A fastener 100 could penetrate and secure together the opposing open base end 108 and its respective angled pipe end 104. The other unattached, second pipe opening 110 of the angled pipe end 104 could receive and provide pivotal attachment to a respective first end 86 of the anchor leg 88. The outside edge of the first end 86 could be beveled to provide the necessary space for the pivotal movement of the anchor leg 88 within the second pipe opening 110. The second pipe opening's inner edge could also be beveled to provide additional space for such pivotal movement by the anchor leg 88.

Figure 3:
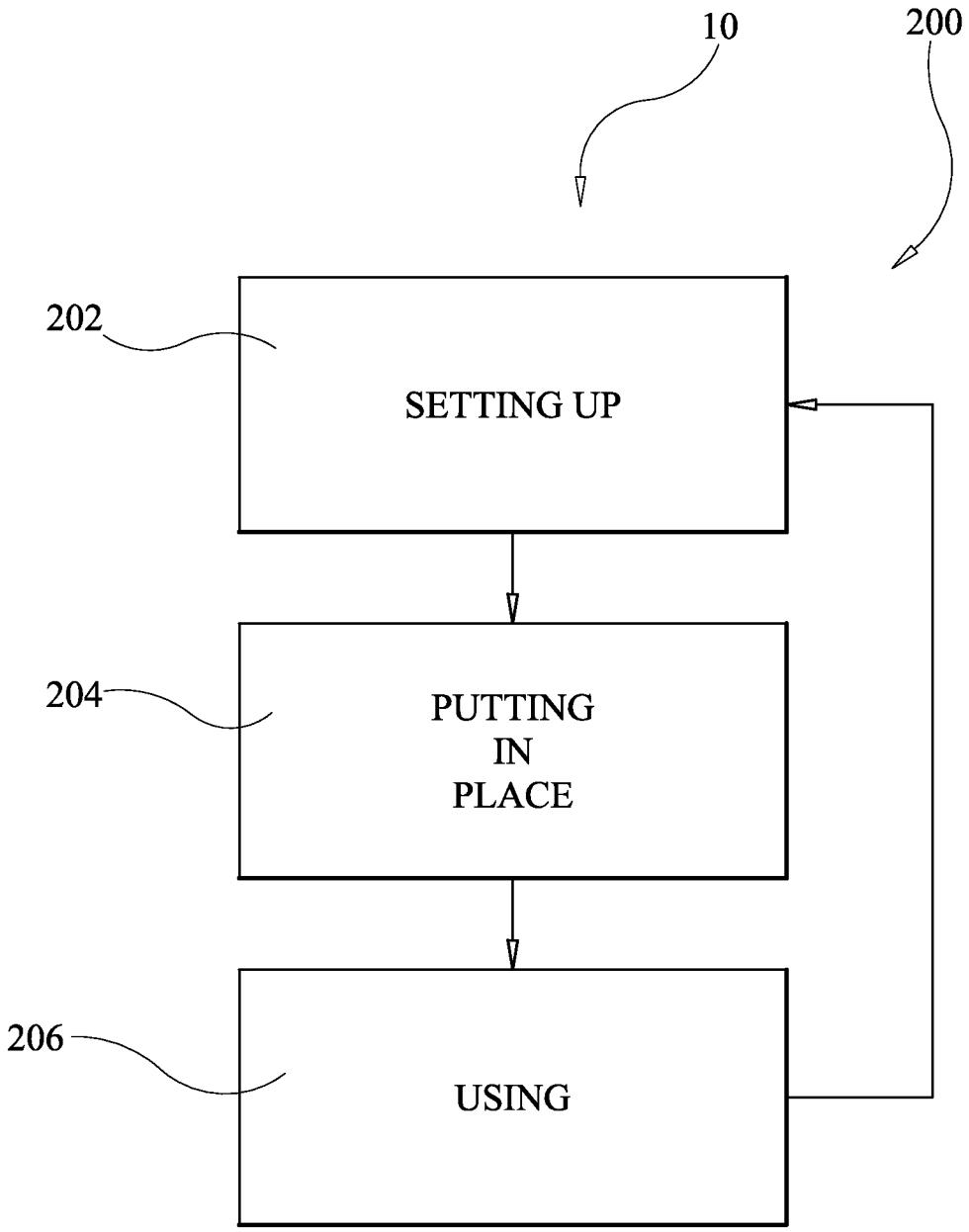
FIG. 3 is substantially a flowchart showing one possible process or methodology for operating the invention.

As shown in FIG. 3, one possible embodiment of the invention 10 could be a process or methodology 200 for operating the carpet stretcher 20. This process 200 may start with step 202, setting up of the carpet stretcher. In step 202, the operator could examine a portion of carpet to be stretched to determine how to setup the invention 10 to accomplish the desired operation. In setting up the invention 10, the operator may ensure that the first telescopic portion 22 is in a compacted state (e.g., the handle is in its upright position.) Then the operator may adjust the distance between the first telescopic portion and the second anchor portion by moving and then locking the first hollow tube relative to the second hollow tube. In one version, the apertures and appropriate perforations can be aligned and a faster (bolt, clip pin, etc.) can be passed through the aligned apertures and perforations (and if a bolt, reversibly secured in place by a respective nut.) At this point, the process 200 is substantially completed and process 200 may proceed to the next step 204, putting the carpet stretcher in place upon carpet.

In 204, putting the carpet stretcher in place upon carpet, the operator can place the carpet stretcher in place upon that the section of carpeting to be pushed forward towards an unsecured carpet edge that is to secured to the floor. In large convention rooms, the carpet stretcher may be deployed in successive stretching actions, working from one secured edge of the carpet to the opposing unsecured edge of the carpet that is being pushed forward/stretched to a desired position upon the floor. The front telescopic portion may be aligned in a perpendicular fashion to the unsecured edge of the carpet that is to be pushed forward/stretched while the rear anchor portion may be directed to the opposing secured edge of the carpet.

The carpet stretcher can engage the carpet by placing the front telescopic portion's pin pad on the carpet first. Then the rest of the carpet stretcher can be lowered so that the pin pads of the rear anchor portion can be placed upon and reversibly anchor to only the carpet. It should be noted that the invention only engages the carpet and not any building structure supporting or proximate to the carpet. When placing the rear anchor pin pads upon the carpet, it is generally preferable to have each of the anchor legs positioned at forty-five) (45°) degrees relative to the base. Once this step completed, the process 200 could progress to the next step 206, using the carpet stretcher.

In step 206, using the carpet stretcher, the operator can place its knee or other suitable portion of its body upon the cushion of base. The operator can then lean upon the base as the operator grasps and presses down on the grip 58 of the handle 52 towards the back section 26, the combined motion of the handle 52 and lever 60 as they travel downward together substantially forces apart the two sections 24, 26 to generally telescopically increase the length of the front telescopic portion 22. This lengthening action may create a rearward force traveling along the central longitudinal axis 46 of the carpentry stretcher 20 towards the rear anchor portion 80. This action also substantially causes the front telescopic portion 22 (as anchored by the second anchor portion 80) to move and push forward the carpet 300 ahead of it to substantially create the carpet-stretching motion for the invention 10.

The inventor believes when one or both anchor legs move out of their initial placement of their forty-five(45°) degree angles relative to the base during this operation, this action causes a portion some of the rearward force (as created by the extension of front telescopic portion/stretching mechanism) to be generally redirected laterally relative to the invention's center longitudinal axis. This movement of the anchor legs about the base/pivoting of the base about the anchor legs/the lateral redirection of the rearward force may cause anchoring legs' pin pads to move/stretch laterally a portion of the carpet located proximately between the anchoring legs to otherwise prevent the remaining rearward force from creating wrinkles in that portion of the carpet.

Once the portion of the carpet that is pushed forward or stretched appropriately is secured to the desired portion of the floor surface; the handle can be brought upward to generally telescopically contract the front telescopic portion/shorten the operating length of the invention 10; alleviating the rearward force; and allowing the carpet stretcher to be removed from the carpet. If the operator wishes to use the invention to stretch more carpet, the process can generally move back to step 202.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As generally seen above, the invention is a carpet-anchored carpet stretcher whose rear anchor portion has a base and pair of pivoting legs at 45° degree relationship. The rearward force created by the carpet stretcher for the carpet-stretching motion could cause the base and anchor legs to move out of their respective 45° degree relationship resulting in a lateral redirection of at least a portion of the rearward force. This lateral redirection of the rearward force could substantially cause a lateral movement of the carpet between the anchor legs that can be seen as generally preventing wrinkles that could otherwise occur in that portion of the carpet due to the rearward force.

What is claimed is:

1. A carpet-anchored carpet stretcher in combination with a carpet comprising:

(A) a front telescopic portion, the front telescopic portion reversibly anchors only to a carpet and connects to a rear anchor portion, the front telescopic portion further comprises a stretching mechanism that lengthens the front telescopic portion;

(B) the rear anchor portion, the rear anchor portion having a base with two opposing ends, each opposing end pivotally connecting to one end of a respective anchor leg while the other end of the respective anchor leg reversibly anchors only to the carpet with each anchor leg is limited in its movement in only being able to move from a forty-three degree angle to a forty-seven degree angle relative to the anchor leg's base;

(C) the carpet to which the front telescopic portion and the rear anchor portion are removably attached;

wherein the stretching mechanism generates a rearward force to the rear anchor portion that laterally redistributes a portion of the rearward force to a portion of the carpet located proximately between the anchor legs to otherwise prevent the creation of one or more wrinkles in the portion of the carpet.

2. The combination of claim 1 wherein the rear anchor portion laterally moves the portion of the carpet located proximately between the anchor legs to otherwise prevent the rearward force from creating the one or more wrinkles in that portion of the carpet.

3. The combination of claim 1 wherein the base moves the anchor legs to laterally move the portion of the carpet located proximately between the anchor legs to prevent the rearward force from creating the one or more wrinkles in the portion of the carpet.

4. The combination of claim 1 wherein the base moves the anchor legs to cause them to laterally move the portion of the carpet located proximately between the anchor legs to otherwise prevent the one or more wrinkles in the portion of the carpet.

5. The combination of claim 1 wherein the redistribution of at least a portion of the rearward force laterally causes a lateral movement of the portion of the carpet located proximately between the anchor legs to otherwise prevent the remainder rearward force from creating the one or more wrinkles in the portion of the carpet.

6. The combination of claim 1 wherein each anchor leg is initially placed at 45° degrees respective to the base when the carpet-anchored carpet stretcher is placed upon the carpet.

7. The combination of claim 6 wherein one or more of the anchor legs moves up to 2° degrees away from its initial 45° degrees angle relationship to the base to laterally move the portion of the carpet located proximately between the anchor legs to otherwise prevent the creation of the one or more wrinkles in the portion of the carpet.

8. The combination of claim 1 wherein one or more of the anchor legs pivotally moving from a forty-five degree relationship with the base causes at least a portion of the rearward force created by the stretching mechanism to be redistributed laterally relative to a centerline longitudinal axis of the carpet-anchored carpet stretcher.

9. A carpet stretcher comprising:

(A) a front telescopic portion that reversibly anchors only to a carpet, the front telescopic portion further having a capacity for increasing a length of the carpet stretcher, the capacity further creates a rearward force directed to a rear anchor portion that is attached to the front telescopic portion;

(B) the rear anchor portion having a base, the base pivotally connects to a pair of anchor legs, each anchor leg further reversibly anchors only to the carpet, with each anchor leg is limited in its movement in only being able to move from a forty-three degree angle to a forty-seven degree angle relative to the base;

wherein the rearward force causes at least one anchor leg of the pair of anchor legs to redistribute a portion of the rearward force laterally to otherwise prevent a remaining portion of the rearward force from creating one or more wrinkles in a portion of the carpet proximately located between the pair of anchor legs.

10. The carpet stretcher of claim 9 wherein the base moves the pair of anchor legs to laterally move the portion of the carpet located proximately between the pair of anchor legs to prevent the creation of the one or more wrinkles in the portion of the carpet.

11. The carpet stretcher of claim 9 wherein the pair of anchor legs move about the base to laterally move the portion of the carpet located proximately between the pair of anchor legs to prevent the creation of the one or more wrinkles in the portion of the carpet.

12. The carpet stretcher of claim 9 wherein the base has a pair of spaced-apart, angled opposing ends, each angled opposing end being at a forty five degree angle to the remainder of the base, each angled opposing end further pivotally connecting to an end of a respective anchor leg of the pair of anchor legs.

13. The carpet stretcher of claim 9 wherein one or more of the pair of anchor legs pivotally moving from a forty-five degree relationship with the base causes the rearward force created by the front telescopic portion to be directed laterally relative to a central longitudinal axis of the carpet stretcher.

14. A process for operating a carpet-anchored only carpet stretcher comprising of the following steps:

(A) providing the carpet-anchored only carpet stretcher that only reversibly anchors to a carpet, the carpet-anchored only carpet stretcher having front telescopic portion with a capacity for increasing the length of the front telescopic portion, the front telescopic portion only reversibly anchors to the carpet, the front telescopic portion connecting to a rear anchor portion having a base with a pair of spaced-apart, angled opposing ends, each angled opposing end further pivotally connects to a respective anchor leg with each anchor leg is being able to move from a forty-three degree angle to a forty-seven degree angle relative to the base, each anchor leg that only reversibly anchors to the carpet;

(B) engaging the carpet with the carpet-anchored only carpet stretcher while the front telescopic portion is in a compacted state;

(C) using the capacity for increasing the length of the front telescopic portion to further expand a length of the carpet-anchored only carpet stretcher and impart a rearward force towards the rear anchoring portion; and (D) redistributing a portion of the rearward force laterally through the rear anchoring portion to a portion of carpet located between the anchor legs to otherwise prevent a creation of one or more wrinkles in the portion of the carpet.

15. The process of claim 14 wherein the redistributing a portion of the rearward force laterally further comprises a step of moving the anchor legs to distribute some of the rearward force laterally.

16. The process of claim 15 wherein the moving the anchor legs further comprises a step of moving one or both anchor legs away from a forty-five degree relationship by a maximum of two degrees relative to the base to cause at least the portion of the rearward force generated by the front telescopic portion to be directed laterally relative to a centerline longitudinal axis of the carpet stretcher.

17. The process of claim 14 wherein the redistributing a portion of the rearward force laterally further comprises a step of moving the base to move the anchor legs to distribute some of the rearward force laterally.

18. The process of claim 14 wherein the distributing some of the rearward force laterally further comprises a step of moving the base to move the anchor legs to laterally move the portion of the carpet proximately located between the anchor legs to otherwise prevent the creation of the one or more wrinkles in the portion of the carpet.

19. The process of claim 14 wherein the redistributing a portion of the rearward force laterally further comprises a step of moving the anchor legs to laterally move the portion of the carpet proximately located between the anchor legs to otherwise prevent the creation of the one or more wrinkles in the portion of the carpet.

* * * * *